US007730926B2

(12) United States Patent
Moriya et al.

(10) Patent No.: US 7,730,926 B2
(45) Date of Patent: Jun. 8, 2010

(54) SLIDING SCREEN DOOR

(75) Inventors: Hirofumi Moriya, Tokyo (JP); Takashi Moriya, Tokyo (JP)

(73) Assignee: Seiki Sogyo Co., Ltd., Tokyo (JP)

( * ) Notice: Subject to any disclaimer, the term of this patent is extended or adjusted under 35 U.S.C. 154(b) by 243 days.

(21) Appl. No.: 10/575,486

(22) PCT Filed: Oct. 16, 2003

(86) PCT No.: PCT/JP03/13260

§ 371 (c)(1),
(2), (4) Date: Apr. 12, 2006

(87) PCT Pub. No.: WO2004/029398

PCT Pub. Date: Apr. 8, 2004

(65) Prior Publication Data

US 2007/0029053 A1 Feb. 8, 2007

(51) Int. Cl.
*E06B 3/94* (2006.01)

(52) U.S. Cl. ..... 160/84.06; 160/84.04

(58) Field of Classification Search ..... 160/84.06, 160/84.04, 84.05, 265, 201, 271, 272, 194, 160/84.03
See application file for complete search history.

(56) References Cited

U.S. PATENT DOCUMENTS

| | | | | | |
|---|---|---|---|---|---|
| 4,673,018 | A * | 6/1987 | Judkins | ..... | 160/84.06 |
| 4,694,877 | A * | 9/1987 | Dunbar | ..... | 160/273.1 |
| 5,351,737 | A * | 10/1994 | Hoshiyama | ..... | 160/84.03 |
| 5,377,737 | A * | 1/1995 | Moriya et al. | ..... | 160/84.06 |
| 5,456,303 | A * | 10/1995 | Horinouchi | ..... | 160/84.04 |
| 5,873,401 | A * | 2/1999 | Tsuchida | ..... | 160/84.04 |
| 5,979,533 | A * | 11/1999 | Dupuie | ..... | 160/84.06 |
| 6,059,007 | A * | 5/2000 | Tomita | ..... | 160/242 |
| 6,186,212 | B1 * | 2/2001 | Tsuchida | ..... | 160/84.06 |
| 6,318,438 | B1 * | 11/2001 | Uno et al. | ..... | 160/31 |
| 6,978,820 | B2 * | 12/2005 | Aoki | ..... | 160/84.06 |

FOREIGN PATENT DOCUMENTS

| | | |
|---|---|---|
| JP | 4-72177 | 6/1992 |
| JP | 2579437 | 11/1996 |
| JP | 3057007 | 4/2000 |
| JP | 2001-207764 | 8/2001 |
| JP | 2002-357068 | 12/2002 |
| JP | 2002-371776 | 12/2002 |
| JP | 2003-138869 | 5/2003 |

* cited by examiner

*Primary Examiner*—David Purol
(74) *Attorney, Agent, or Firm*—Oblon, Spivak, McClelland, Maier & Neustadt, L.L.P.

(57) ABSTRACT

A sliding screen door in which stretching force of a wire is easily adjusted when a screen is in a stretched condition, and expansion of the screen caused by wind or the like can be appropriately suppressed without increasing operation force to be applied to an operating doorframe for the operation to stretch the screen. The sliding screen door is constructed such that wires, whose one ends are fixed to a vertical frame member are drooped in the operating doorframe via a guiding member, which is provided in the operating doorframe, after being inserted into the screen, and a sinker is dangled at tip ends of the wires. A spring member is interposed between the sinker and a contacting portion to be a rising uppermost limit of the sinker, and a wire adjusting mechanism for adjusting a length and the stretching force of the wire is installed in the vertical frame member.

10 Claims, 11 Drawing Sheets

SLIDING SCREEN DOOR

TECHNICAL FIELD

The present invention relates to a screen door attached to an opening portion of a building for protection from insects, which is capable of freely opening and closing by horizontally pulling a screen being free for expansion and contraction in a style of an accordion.

BACKGROUND ART

A sliding screen door is heretofore known as described in Japanese Unexamined Patent Application Publication No. 2002-371776. In the sliding screen door, a screen configured to be free for expansion and contraction in a style of an accordion by means of alternately folding in a reverse direction at numbers of folded portions being in parallel with each other spaced at even intervals is constructed to be free for opening and closing in a style of horizontal pulling in a frame body. In the sliding screen door, in which one end of the aforementioned screen is fixed to a vertical frame member of the aforementioned frame body and the other end of the screen is attached to an operating doorframe for open-and-close operation, which slides along the aforementioned frame body, a wire whose one end is fixed to the aforementioned vertical frame member is horizontally inserted into the aforementioned screen and is drooped in the operating doorframe via a guide member provided in the aforementioned operating doorframe. In addition, a sinker is dangled at a tip end of the wire and a spring member is interposed between the sinker located at a position when the screen is in a condition of being stretched and a contacting portion to be a rising uppermost limit of the sinker.

In the aforementioned known sliding screen door, stretching force that affects the wire only when the screen is in a stretched condition is increased without excessively increasing size of the sinker to be dangled from the wire by means of installing the aforementioned spring member, resulting in suppression for expansion of the screen when the outside force caused by a certain level of strong wind, or the like, is affected to the stretched screen. As a result, both upper and lower ends of screen can be suppressed from a deviation from a horizontal frame member as well as possible. However, since the stretching force of the wire in the stretched condition of the screen cannot be adjusted, even when the stretching force of the wire in the stretched condition of the screen due to installing of the spring member is excessively strong, although the expansion of the screen due to the wind or the like can further be suppressed, not only large operating force is required to move the operating doorframe toward a stretched position for the operation to stretch the screen, but also the operating doorframe moves at an abnormal speed because strong action force of the spring member is added to the action force of the sinker when a locked state of the operating doorframe is released by a latching mechanism. Further, when the stretching force of the wire in a case when the screen is in the stretched condition is excessively weak, although the operating force for the operating doorframe for stretching the screen is sufficiently small, there has been a problem that the expansion of the screen due to the wind or the like cannot be sufficiently suppressed.

In addition, in the aforementioned sliding screen door, since length of the horizontal frame member is determined aligning with an opening of a building where the sliding screen door is installed, it is required that adjustment of the length of the wire can be easily performed in a wide range.

DISCLOSURE OF INVENTION

An object of the present invention is to solve these and above problems and to provide a sliding screen door capable of adjusting stretching force of a wire in a wide range with ease when a screen is in a stretched condition, and capable of fully suppressing an expansion of the screen due to wind or the like without increasing operating force for an operating doorframe, for stretching operation of the screen.

Another object of the present invention is to provide a sliding screen door capable of easily adjusting the stretching force of the aforementioned wire by means of only adjusting an attaching position of an adjusting member by means of sliding the adjusting member of a wire adjusting mechanism, and capable of fully increasing and decreasing the stretching force of the aforementioned wire even when a moving distance of the adjusting member is short.

Still another object of the present invention is to provide a sliding screen door capable of covering a screw for fixing a vertical frame member to an opening portion of a building, or the wire adjusting mechanism installed in the vertical frame member by means of utilizing an end plate for attaching the screen, and along therewith, the screen can be easily replaced, in addition to that the stretching force of the wire when the aforementioned screen is in the stretched condition can be easily adjusted.

A further object of the present invention is to provide a sliding screen door capable of automatically latching the operating doorframe with a latching mechanism mounted on the vertical frame member only when the operating doorframe is moved to a closing position, and a latching position of the operating doorframe and the latching mechanism can be easily adjusted.

Still a further object of the present invention is to provide a sliding screen door configured such that the latching is not released due to relatively careless operation, while the structure is simple, because there is no guarantee that a dangerous situation does not occur in case the screen is unexpectedly folded when the latching of the operating doorframe with the vertical frame member is unexpectedly released by means of the aforementioned latching mechanism in the sliding screen door configured to house the screen by means of action force of the aforementioned sinker and a spring member.

To solve the above-described problems, a sliding screen door of the present invention is characterized in that, a screen configured to be free for expansion and contraction in a style of an accordion by means of alternately folding in a reverse direction at numbers of folded portions being in parallel with each other is constructed to be free for opening and closing in a style of horizontal pulling in a frame body, in which one end of the screen is fixed to a vertical frame member of the frame body and the other end of the screen is attached to an operating doorframe for open and close operation sliding along the frame body, in which a wire whose one end is fixed to the vertical frame member is horizontally inserted into the screen and drooped in the operating doorframe via a guide member provided in the operating doorframe, and a sinker is dangled at a tip end of the wire in the operating doorframe, and in which a spring member being in a slightly compressed condition when the screen is in a stretched condition is interposed between the sinker and a contacting portion to be a rising uppermost limit thereof, and in which a wire adjusting mechanism for adjusting stretching force of the wire when the screen is in the stretched condition by means of adjusting force of repulsion of the spring member when the screen is in the stretched condition by means of adjusting a length of the wire is installed in the vertical frame member.

In the preferred embodiment of the aforementioned sliding screen door, the wire adjusting mechanism includes a guide part attached to the vertical frame member, and an adjusting member capable of sliding along the longitudinal direction of the vertical frame member and being attached to the vertical frame member at a slid position, and in which the wire adjusting mechanism is constructed to adjust the length of the wire by means of adjusting an attaching position of the adjusting member to the vertical frame member by sliding the adjusting member in a condition in which the wire folded back after passing through the guide part is united and fixed to the adjusting member, or in a condition in which the wire is further folded back at the adjusting member and returned again to the guide part and united and fixed to the guide part. Accordingly, the length of the wire can be adjusted by means of adjusting the attaching position of the adjusting member by sliding the same in a condition that the wire is united and fixed between the guide part and the adjusting member.

Further, in another preferred embodiment of the sliding screen door, the vertical frame member includes a sliding groove in a longitudinal direction for slidably housing the adjusting member, in which the guide part is an approximately plate-shaped member being fixed to the sliding groove, including a guide hole formed by penetrating the guide part for the wire to be inserted through, and a wire connecting portion for guiding and/or uniting and fixing the wire, and in which the adjusting member is desirable to be an approximately plate-shaped member including a wire connecting portion for guiding the wire and/or for uniting and fixing the wire, and a screw hole where a fixing screw for detachably fixing the adjusting member to the sliding groove is screwed. Furthermore, the sliding groove in the vertical frame member has approximately C-shaped section, including projecting walls being inwardly protruding at a pair of groove side walls of the sliding groove, and in which the adjusting member can be detachably fixed to the sliding groove by means of sandwiching the projecting walls between the adjusting member and a nut where a fixing screw is screwed through the screw hole of the adjusting member.

Still further, in another preferred embodiment of the sliding screen door, the screen includes a long plate-shaped side frame side end plate, and the side frame side end plate can be detachably fixed in a manner so as to cover the guide part and a guide member in the sliding groove formed at least in the vertical frame member.

Further, in another preferred embodiment of the sliding screen door, a latching mechanism is installed in the vertical frame member where the screen is not fixed, in which the latching mechanism locks the operating doorframe at a closing position by means of being automatically latched with a receiving hole formed in the operating doorframe when the operating doorframe is moved to the closing position, and the latched state is released by means of raising operation for an operating member while resisting force of gravity. The latching mechanism can include a sliding piece being slidable in an above and below direction within a definite range in the vertical frame member; a latch main body connected to the sliding piece; and a position adjusting device for adjusting a lowering position of the latch main body by its own weight.

In still another preferred embodiment of the sliding screen door, the vertical frame member in which the latching mechanism is installed includes a pair of side walls extending in a longitudinal direction having a notched portion at a position, in which the latching mechanism is installed, and a connecting wall connecting the pair of the side walls and including a sliding groove extending in a longitudinal direction, and in which the sliding piece includes a hooking portion being slidably inserted into the sliding groove and latched with a receiving hole formed in the operating doorframe, and in which the latch main body includes an operating member outwardly protruding from the notched portion of the side walls.

In a sliding screen door having the above-described construction, since a wire adjusting mechanism for adjusting force of repulsion of the aforementioned spring member that occurs when the aforementioned screen is in a stretched condition, by means of adjusting length of the aforementioned wire is installed in the aforementioned vertical frame member, the stretching force of the wire caused when the screen is in the stretched condition can be easily adjusted. Accordingly, the sliding screen door capable of appropriately suppressing expansion of the screen caused by wind or the like can be provided without increasing operating force for an operating doorframe for stretching operation of the screen. In addition, since the aforementioned spring member is brought to a slightly compressed state in the stretched condition of the screen, the wire adjusting mechanism can increase or decrease the force of repulsion of the aforementioned spring member only by means of slightly shortening or lengthening the length of the aforementioned wire. Accordingly, the stretching force of the wire when the screen is in the stretched condition can be easily adjusted.

Further, in the aforementioned sliding screen door, the aforementioned wire adjusting mechanism is provided with a guide part attached to the vertical frame member and the adjusting member attached to the vertical frame member in a manner so as to be slidable along a longitudinal direction thereof, and so as to be detachable from the vertical frame member at the slid position thereof. Since the length of the wire which is united and fixed to the guide part and the adjusting member is adjusted only by means of sliding the aforementioned adjusting member and by means of adjusting a position where the adjusting member is attached to the vertical frame member, the length of the wire can be easily adjusted. Furthermore, since the length of the aforementioned wire can be adjusted by a moving distance of the adjusting member or by twice as much as the moving distance of the adjusting member, even the moving distance of the adjusting member is short, the stretching force of the aforementioned wire can be fully increased or decreased.

In addition, since a latching mechanism for automatically latching with a receiving hole formed in the operating doorframe and for locking the operating doorframe at a closing position, when the operating doorframe is moved to the stretch position is installed in the aforementioned vertical frame member, the latching mechanism is automatically latched only by moving the operating doorframe toward the closing position and the operating doorframe can be locked at the closing position. Further, the aforementioned latching mechanism is provided with a position adjusting device for adjusting a lowering position where a latch main body is lowered by its own weight. Therefore, a latching position of the operating doorframe with the latching mechanism can be easily adjusted.

Furthermore, in the sliding screen door configured to be able to house the screen by means of action force of the aforementioned sinker and the spring member, when the latching of the operating doorframe with the vertical frame member by means of the latching mechanism is carelessly released, there is no guarantee that a dangerous situation does not occur in case the screen is unexpectedly folded. In general, an operation member for releasing the latching is relatively easy to operate when the operation member is configured to be able to release the latching by means of pressing down the same from above. However, in this case, on the contrary, the possibility that the latching is carelessly released is large. However, in the aforementioned latching mechanism, since the latching is configured be released by means of raising the operating member from below at only a certain distance, the latching is not released by relatively careless operation, such as that a hand moved by the side of the operating member touches the same or something taken by hand touches the operating member. In addition, because the latching is released by means of raising the operating member, a hook portion of the latching mechanism can be hooked by force of gravity and there is no need to hook the operating member by a spring or the like, resulting in simplifying the structure.

BEST MODE FOR CARRYING OUT THE INVENTION

FIGS. 1 through 17 illustrate the embodiment of a sliding screen door with respect to the present invention.

Figure 1:
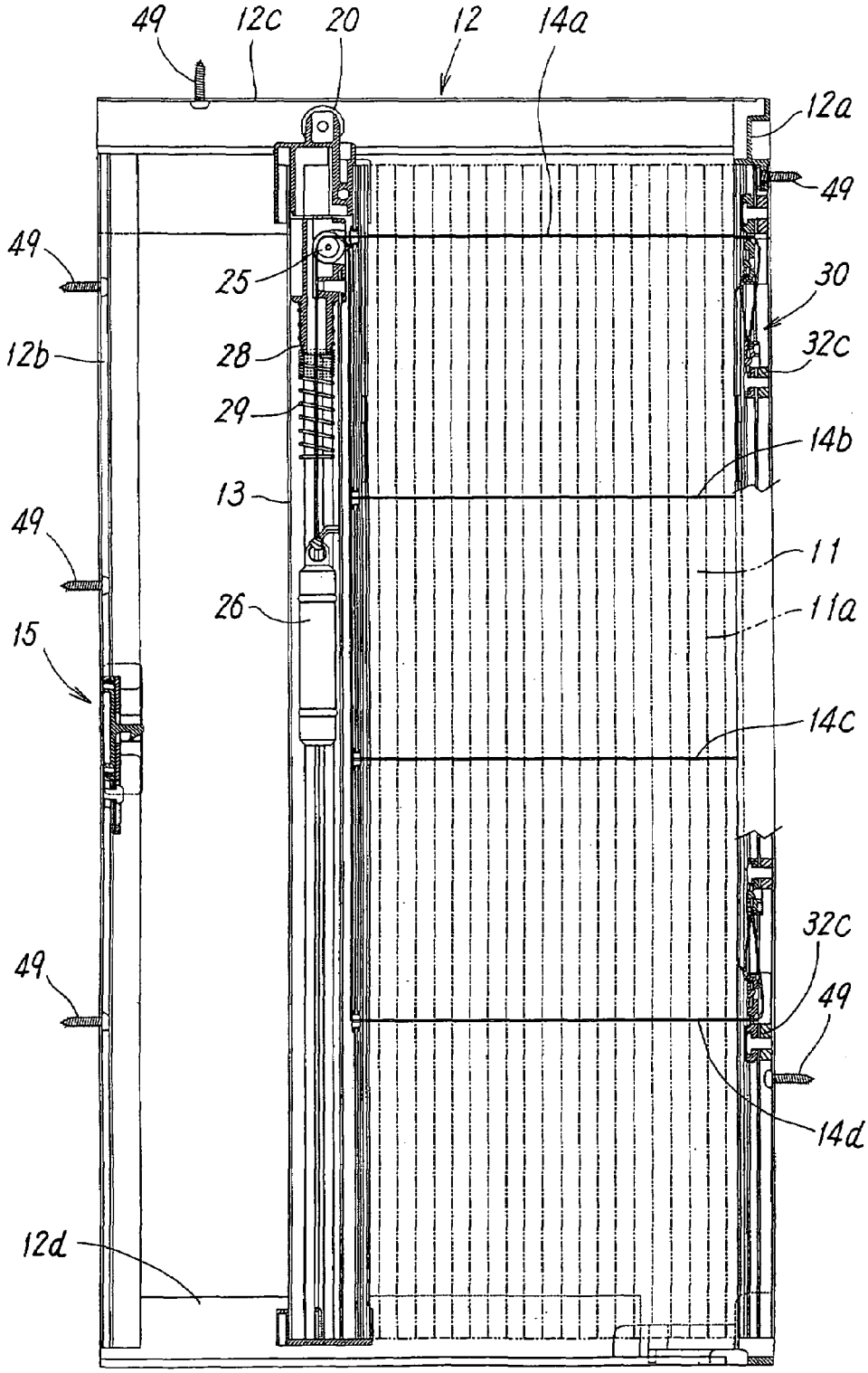
FIG. 1 is a partially broken elevation showing an embodiment of a sliding screen door with respect to the present invention.
Figure 2:
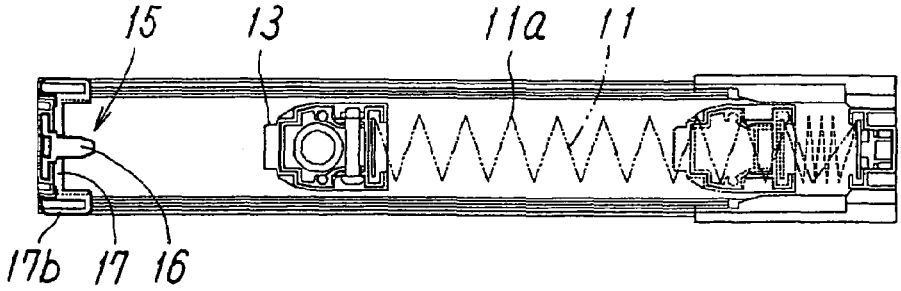
FIG. 2 is a cross-sectional plan view of the same.
Figure 3:
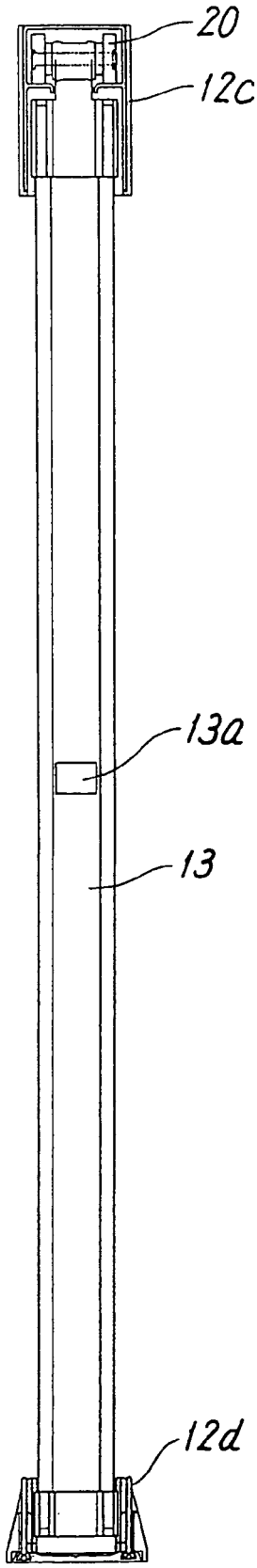
FIG. 3 is a side elevation showing an operating doorframe in the embodiment.
Figure 4:
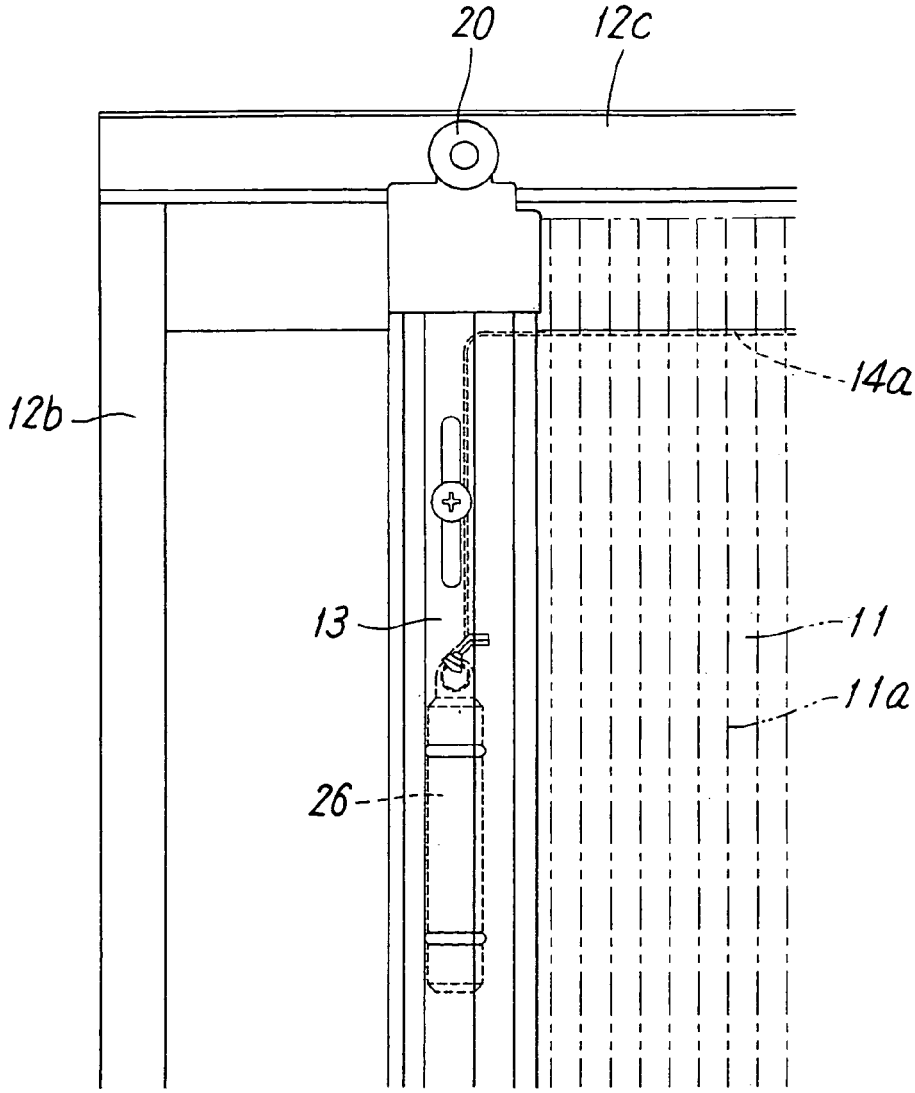
FIG. 4 is an enlarged elevation of a main part in the embodiment.
Figure 5:
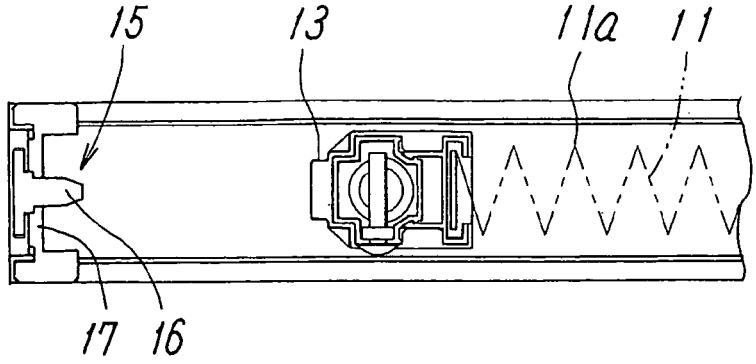
FIG. 5 is a partially enlarged cross-sectional plan view of the embodiment.
Figure 6:
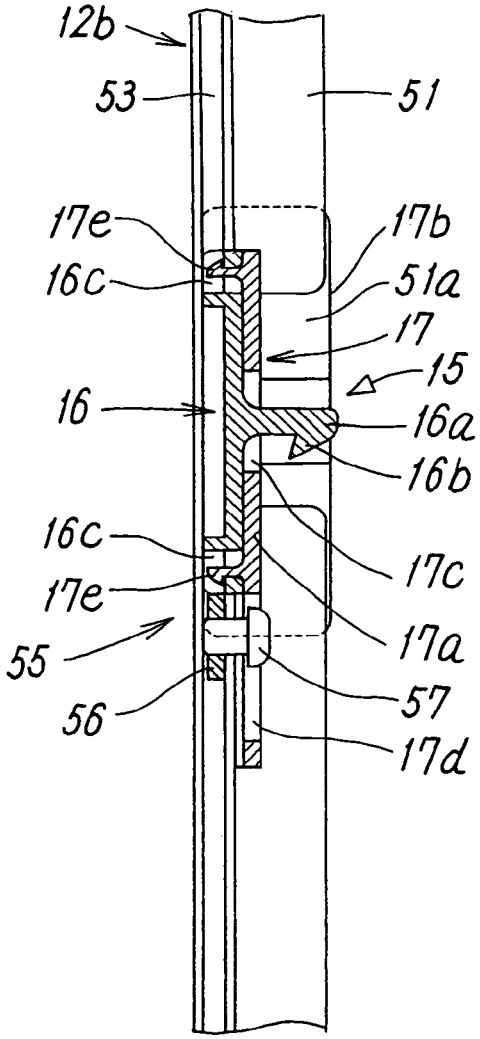
FIG. 6 is a partially broken elevation showing a condition in which a latching mechanism is installed in a side frame member of the embodiment.
Figure 7:
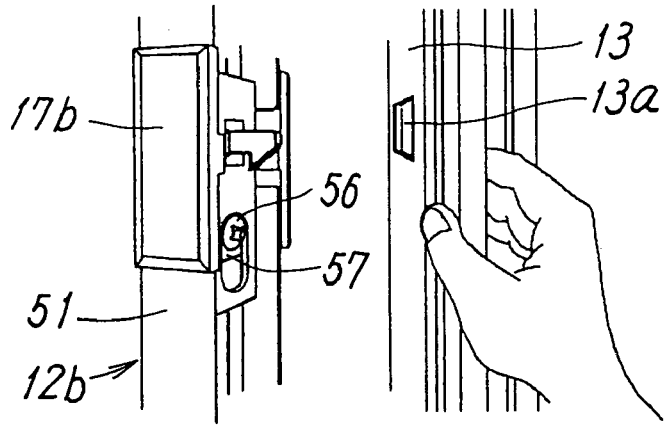
FIG. 7 is a perspective view showing a condition in which the latching mechanism installed in the side frame member is latched with the operating doorframe of the embodiment.
Figure 8:
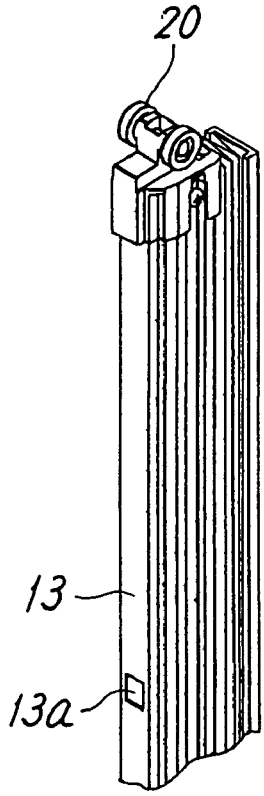
FIG. 8 is a perspective view of a main part of the operating doorframe.

The sliding screen door is constructed such that a screen 11 for protection from insects is configured to be free for opening and closing in the style of horizontal pulling in a frame member 12 fixed to an opening portion of a building. Further, the screen 11 for protection from the insects is configured to be free for expansion and contraction in the style of an accordion by means of alternately folding in reverse directions at the numbers of folded portions 11*a* which is in parallel with each other and is spaced at even intervals, as shown in FIGS. 1 and 2. The frame body 12 is constructed by mutually connecting each of a pair of vertical frame members, 12*a* and 12*b* made of aluminum or synthetic resin and upper and lower horizontal frame members, 12*c* and 12*d*, at four corners.

One end of the aforementioned screen 11 is fixed to one of the vertical frame members 12*a* of the aforementioned frame body 12 and the other end of the screen 11 is attached to an operating doorframe 13 for opening and closing operation, which slides along the upper and lower horizontal frame members, 12*c* and 12*d*, of the aforementioned frame body 12. The operating doorframe 13 causes a track roller 20 attached to an upper end thereof to run on a rail provided in an upper part of the horizontal frame member 12*c*. In addition, upper and lower ends of the screen 11 are guided by means of a groove provided in the aforementioned horizontal frame members, 12*c* and 12*d*.

In the aforementioned sliding screen door, wires, 14*a* through 14*d* are inserted into upper and lower portions in the screen 11 and in the middle portions thereof at multistage in each of horizontal directions spaced at approximately even intervals. Further, each of one ends of the wires, 14*a* through 14*d*, is attached to the aforementioned vertical frame member 12*a* and the other ends of these wires 14*a* through 14*d* are inserted through the operating doorframe 13 after inserting through the screen 12. In the wires, 14*a*, 14*b*, 14*c*, and 14*d*, the wires other than the topmost wire 14*a* are guided upward in the operating doorframe 13 via a turnaround element (not shown), and are drooped in the operating doorframe 13 together with the topmost wire 14*a* via a guide member (roller) 25 provided at an upper part of the operating doorframe 13. Further, a sinker 26 is dangled at a tip end of those wires, 14*a* through 14*d*, in the operating doorframe 13.

Although the aforementioned wires, 14*a* through 14*d*, being drooped in the operating doorframe 13 can be individually drooped and the sinker 26 can be attached to the tip end thereof, the wires may be drooped by the lump. Thus, when a plurality of the wires, 14*a* through 14*d*, are inserted into the screen 11 at multistage, and the sinker 26 is dangled at the wires in the operating doorframe 13, the operating doorframe 13 can be moved in parallel by means of the stretching force being uniformly affecting each of the wires. Further, expansion or the like of the screen 11 toward the lee side by an action of a wind pressure or the like can be suppressed.

Furthermore, the aforementioned sliding screen door is provided with a spring member 29 in a manner so as to be interposed between the aforementioned sinker 26 and the contacting portion 28 to be a rising uppermost limit of the sinker. The spring member 29 being interposed between the aforementioned sinker 26 and the contacting portion 28 is provided in a manner so as to be in a slightly compressed condition when the screen 11 is in a stretched condition. As for the aforementioned spring member 29, although it is desirable to use a coil spring fitting around a periphery of the wire, a sponge-like member or other elastic member can be used.

In the aforementioned sliding screen door, a wire adjusting mechanism 30 is installed in the aforementioned vertical frame member 12*a*, as shown in FIGS. 10 and 11, and FIGS. 16 and 17. In the wire adjusting mechanism 30, force of repulsion of the aforementioned spring member 29 when the aforementioned screen 11 is in the stretched condition is adjusted by means of adjusting length of the wire 14 and thereby the stretching force of the aforementioned wires, 14*a* through 14*d* (Hereinbelow, one of, or a plurality of wires in the wires, 14*a* through 14*d* is referred to as "wire 14" for short.) when the aforementioned screen 11 is in the stretched condition is adjusted.

Figure 14:
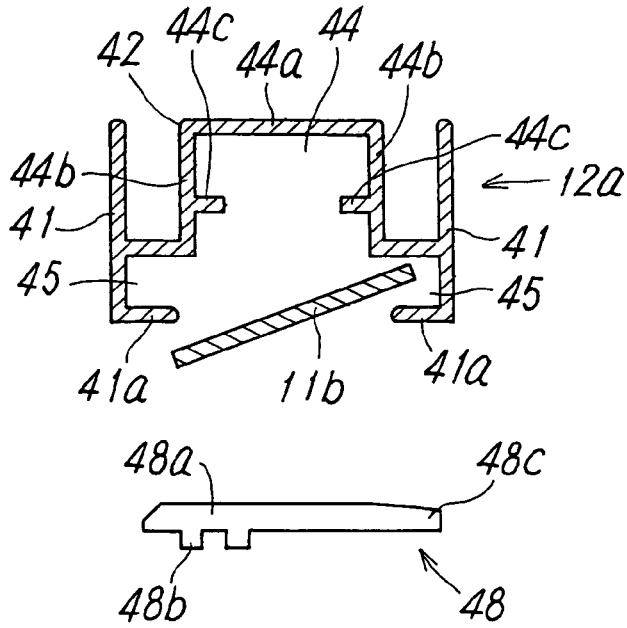
FIG. 14 is a partially enlarged cross-sectional plan view showing a condition in which the side frame side end plate of the screen is being housed in the concave groove of the side frame member.
Figure 15:
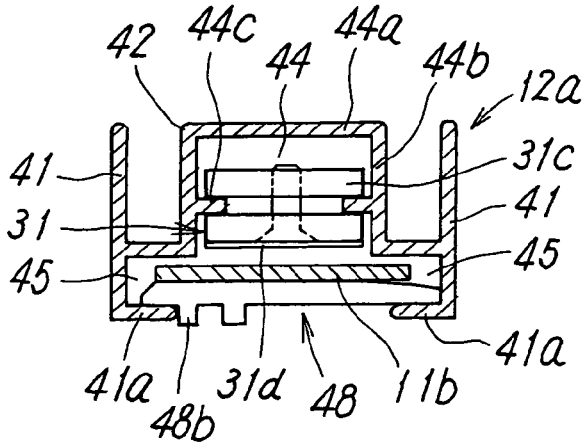
FIG. 15 is a partially enlarged cross-sectional plan view showing a condition in which the side frame side end plate of the screen housed in the concave groove of the side frame member is fixed to the concave groove by means of the fixing member.

In a detailed description, the aforementioned vertical frame member 12*a* is composed of a pair of side walls 41 extending in a longitudinal direction, a connecting wall 42 connecting the pair of the side walls 41 and having a slide groove 44 extending in a longitudinal direction, and a pair of projecting walls 41*a* projecting toward inside from one end side of the aforementioned pair of the side walls 41 while extending in a longitudinal direction, and forming a concave groove 45 at an inside thereof in a longitudinal direction, as shown in FIGS. 14 and 15. The aforementioned slide groove 44 is a groove having approximately concave-shaped cross-section, provided with a pair of groove side walls 44*b* being in parallel with the pair of the side walls 41 of the aforementioned vertical frame member 12*a*, and a groove bottom wall 44*a* connecting the pair of the groove side walls 44*b*, and the pair of the groove side walls 44*b* has a projecting wall 44*c* that projects inwardly.

The aforementioned wire adjusting mechanism 30 is provided with a guide part 31 configured to be slidable in the aforementioned slide groove 44 and to be able to be fixed to the aforementioned slide groove 44 at the slid position thereof and an adjusting member 32.

The aforementioned guide part 31 is a member having approximately plate-shape composed of a guide hole 31*a* formed by means of penetrating the guide part 31, through which the aforementioned wire 14 passes, a wire connecting portion 31*b* that is bent and protruded by means of cutting open and turning over the material in a direction opposite to the adjusting member 32 side so as to guide, and unite and fix the aforementioned wire 14, and a screw hole (not shown) into which a fixing screw 34 for detachably fixing the guide part 31 to the aforementioned slide groove 44 is inserted. On the other hand, the aforementioned adjusting member 32 is a member having approximately plate-shape composed of a wire connecting portion 32*a* that is bent and protruded by means of cutting open and turning over the material in a direction opposite to the guide part 31 side so as to guide, and unite and fix the aforementioned wire 14, and a screw hole (not shown) into which the fixing screw 35 for detachably fixing the adjusting member 32 to the aforementioned slide groove 44 is inserted.

The fixing screws, 34 and 35, of the aforementioned guide part 31 and the adjusting member 32 are screwed into nuts, 31*c* and 32*c*, housed in the groove bottom wall 44*a* side of the aforementioned projecting wall 44*c* of the aforementioned slide groove 44 (Refer to FIGS. 1 and 14.), and are fixed by sandwiching the projecting wall 44*c* at both sides of the slide groove 44 between the aforementioned guide part 31 and the nut 31*a*, and the adjusting member 32 and the nut 32*a*. However, other device may be employed as follows, for example. The screw holes in the guide part 31 and the adjusting member 32, to which the fixing screws, 34 and 35, are inserted are formed to have female screws, and the guide part 31 and the adjusting member 32 are housed in the groove bottom wall 44*a* side of the projecting wall 44*c*. Then, the aforementioned guide part 31 and the adjusting member 32 are pressed to the aforementioned projecting wall 44*c* due to reaction force caused by the fixing screws, 34 and 35, which are screwed into the aforementioned screw holes and pressed to the groove bottom wall 44*a* of the aforementioned slide groove 44. Thus, the guide part 31 and the adjusting member 32 can also be detachably fixed to the aforementioned slide groove 44 at an arbitrary slid position. Further, at a head portion of the fixing screw 34 by which the aforementioned guide part 31 is fixed, a sealing piece 31*d* for covering is adhered to prevent the fixing screw 34 from being removed by a user or the like.

Figure 16:
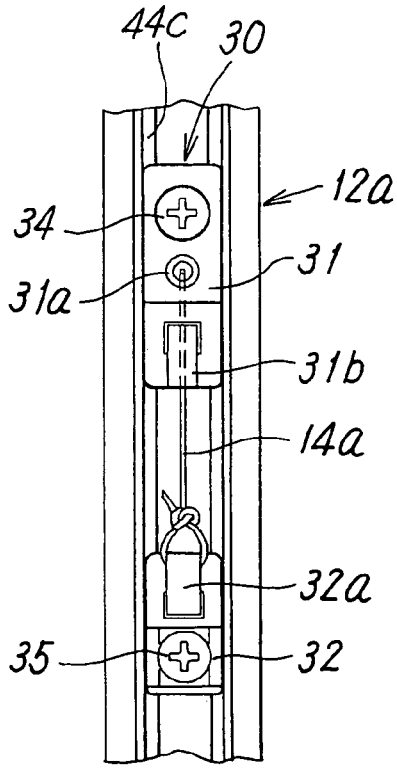
FIG. 16 is a plan view showing a condition of wire-uniting of a wire adjusting mechanism installed in the side frame member.
Figure 17:
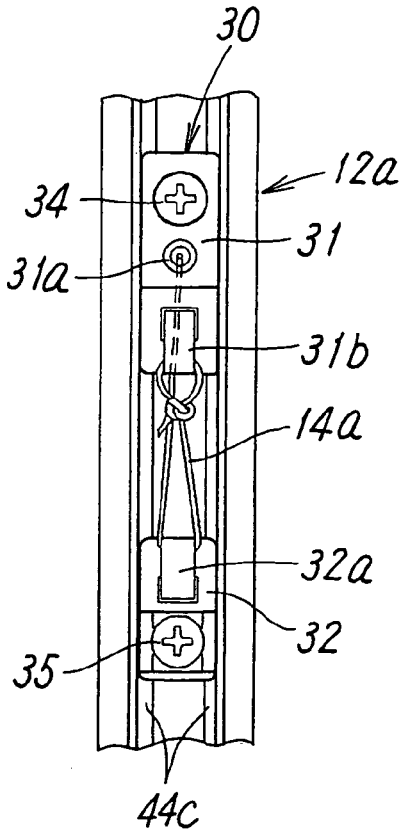
FIG. 17 is a plan view showing a condition of another wire-uniting.

The aforementioned wire adjusting mechanism 30 is configured such that, as shown in FIG. 16, the wire 14 which is folded back through the guide hole 31*a* of the aforementioned guide part 31 is united and fixed to the wire connecting portion 32*a* of the aforementioned adjusting member 32, or, as shown in FIG. 17, the wire which is folded back through the guide hole 31*a* of the aforementioned guide part 31 is further folded back at the wire connecting portion 32*a* of the aforementioned adjusting member 32, and is returned again to the aforementioned guide part 31, and further, is united and fixed to the wire connecting portion 31*b* of the guide part 31.

The aforementioned wire adjusting mechanism 30 is configured such that the aforementioned adjusting member 32 is slid in a condition that the aforementioned wire 14 is united and fixed to the aforementioned adjusting member 32 or the aforementioned guide part 31, and the attaching position of the adjusting member 32 is adjusted. Thereby, the length of the aforementioned wire 14 can be adjusted. Accordingly, the length of the aforementioned wire 14, namely the stretching force of the wire 14 when the screen 11 is in the stretched condition can be easily adjusted by means of only adjusting the attaching position of the aforementioned adjusting member 22 by sliding the same.

In a uniting condition of the wire, shown in FIG. 16, although the length of the aforementioned wire 14 can be adjusted to the extent of the distance at which the aforementioned adjusting member 32 moves, in a uniting condition, shown in FIG. 17, since the wire 14 being folded back passing through the guide hole 31*a* of the aforementioned guide part 31 is further folded back at the wire connecting portion 32*a* of the aforementioned adjusting member 32 and united and fixed to the wire connecting portion 31*b* of the aforementioned guide part 31. As a result, the length of the wire 14 can be adjusted by the length twice as much as the distance for which the aforementioned adjusting member 32 moves. Accordingly, in a case when the moving distance of the adjusting member 32 is short, the length of the wire can be adjusted in a wide range.

Further, the aforementioned wire adjusting mechanism 30 is configured such that since the spring member 29 interposed between the sinker dangled at the tip end of the wire 14 and the contacting portion 28 to be a rising uppermost limit of the sinker is compressed via the wire 14, the force of repulsion of the aforementioned spring member 29, namely the stretching force of the wire can be easily adjusted by means of only adjusting the length of the aforementioned wire 14 by varying the attaching position of the aforementioned adjusting member 32 by sliding the same. As a result, there is no possibility that the operating force for the operating doorframe required for stretching operation for the screen becomes excessively large or the like, and the expansion of the screen caused by he wind or the like can be appropriately suppressed.

Furthermore, the aforementioned sliding screen door is configured such that, as shown in FIGS. 11 through 15, the aforementioned screen 11 is provided with a long plate-shaped side frame side end plate 11*b*, and the side frame side end plate 11*b* is housed between a pair of concave grooves 45 facing each other and extending in a longitudinal direction, which are provided in the aforementioned vertical frame member 12*a*, while passing through a space between a pair of projecting walls 41*a* of the aforementioned vertical frame member 12*a*. The side frame side end plate 11*b* is detachably fixed to the concave groove 45 by means of being sandwiched between the connecting wall 42 that constitutes one side of the side wall of the concave groove and a plurality of fixing members 48 being detachably fixed to the pair of the concave grooves 45.

The aforementioned fixing member 48 is provided with a main body portion 48*a* having approximately rectangular shape, provided with a pair of hooking ridges 48*b* and a pair of elastic leg portions 48*c* extending from both sides of the main body portion 48*a*. The aforementioned fixing member 48 is detachably fixed to the concave groove 45 by means of elastic force of the elastic leg portion 48*c* by inserting the aforementioned elastic leg portion 48*c* into one side of the concave groove 45, and inserting the main body portion 48*a* into the other side of the concave groove 45 while compressing the elastic leg portion 48*c*.

In the aforementioned sliding screen door, since the aforementioned screen 11 is provided with the long plate-shaped side frame side end plate 11*b*, and the side frame side end plate 11*b* can be detachably attached to the aforementioned vertical frame member 12*a*, a screw 49 for fixing the aforementioned vertical frame member 12*a* to the opening portion of the building (Refer to FIGS. 1 or 11.), or the aforementioned wire adjusting mechanism 30 installed in the aforementioned vertical frame member 12*a* can be covered and the side frame side end plate 11*b* can be easily detached by means of the aforementioned fixing member 48. Accordingly, the screen 11 can be easily replaced.

Further, in the aforementioned sliding screen door, as shown in FIGS. 1, 2, 6, 7, and 9, a latching mechanism 15 is provided in the vertical frame member 12*b*, at which the screen 11 is not fixed. The latching mechanism 15 is configured such that when the operating doorframe 13 moves to a closing position where the operating doorframe 13 collides with the vertical frame member 12*b*, the latching mechanism 15 is automatically latched with a receiving hole 13*a* formed in the operating doorframe 13 (Refer to FIGS. 3, 7, and 8.), and locks the operating doorframe 13 at the closing position.

Accordingly, the operating doorframe 13 is held at the closing position, where the screen 11 is brought to be in a stretched condition, by means of the aforementioned latching mechanism 15 resisting against the stretching force of the wires 14*a* through 14*d* caused by the sinker 26.

Figure 9:
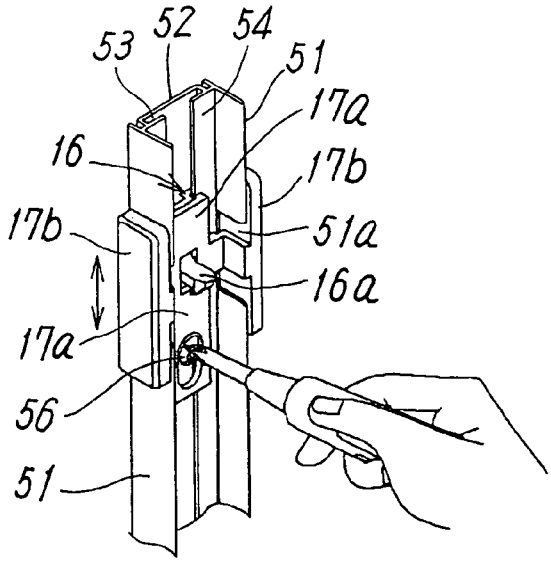
FIG. 9 is perspective view showing an adjusting condition of a position of the latching mechanism installed in the side frame member.
Figure 10:
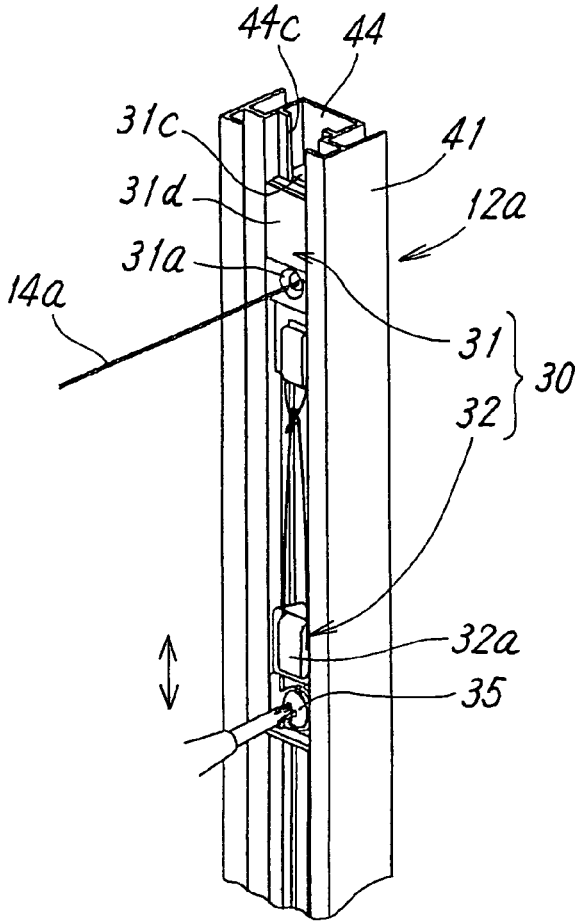
FIG. 10 is perspective view showing a condition in which length of a wire is adjusted by means of a wire adjusting mechanism.
Figure 11:
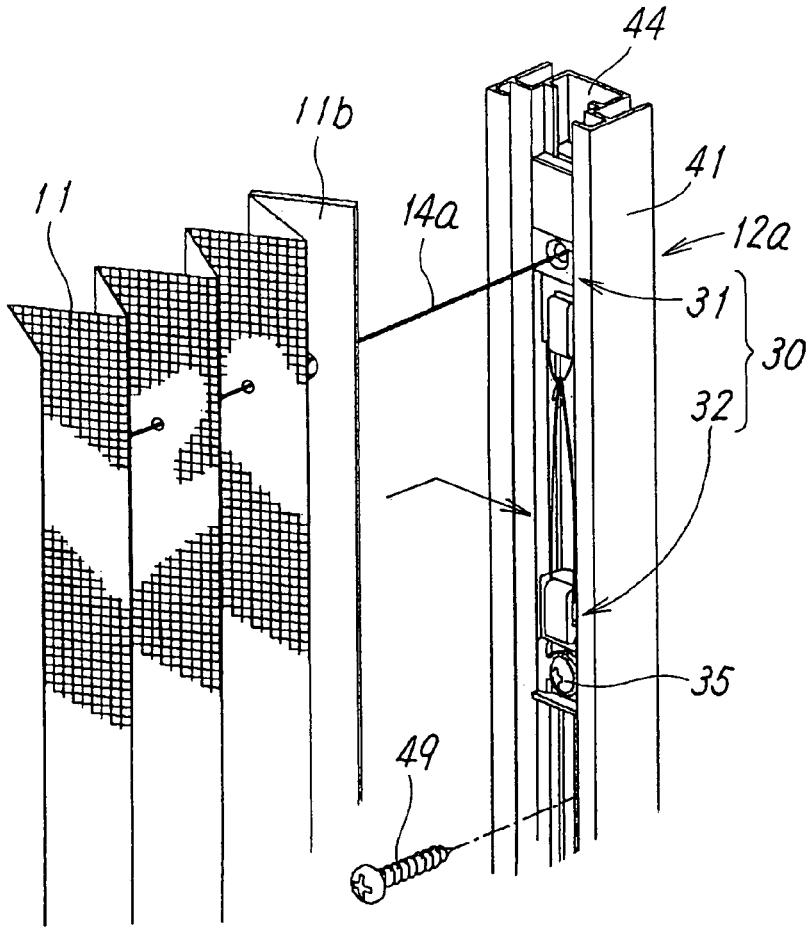
FIG. 11 is a perspective view showing a condition in which a side frame side end plate of the screen is being housed in a concave groove of the side frame member in which the wire adjusting machine is installed.
Figure 12:
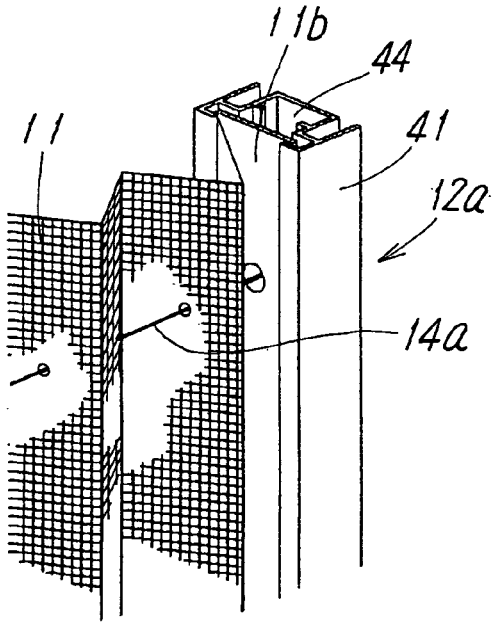
FIG. 12 is a perspective view showing a condition in which the side frame side end plate of the screen is housed in the concave groove of the side frame member.
Figure 13:
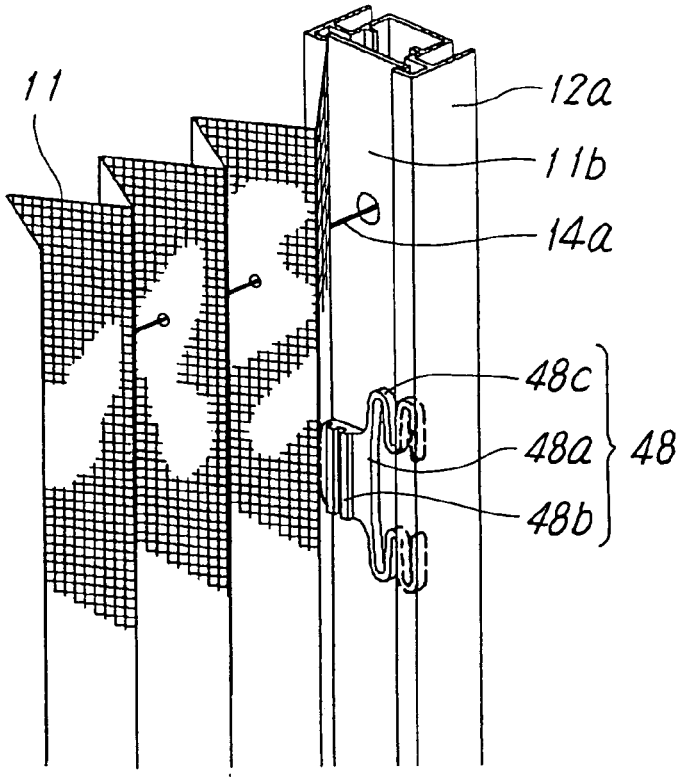
FIG. 13 is a perspective view showing a condition in which the side frame side end plate of the screen housed in the concave groove of the side frame member is fixed to the concave groove by means of a fixing member.

The aforementioned vertical frame member 12*b* is provided with a pair of side walls 51 extending in a longitudinal direction and a connecting wall 52 having a sliding groove 53 that connects the pair of the side walls 51 and extending along a longitudinal direction, as shown in FIG. 9. The vertical frame member 12*b* further includes a notched portion 51*a* in the side wall 51 along a longitudinal direction at a position where the aforementioned latching mechanism 15 is installed. In addition, a pair of projecting walls 54 forming the aforementioned sliding groove 53 is inwardly projected from the pair of the side walls 51.

The aforementioned latching mechanism 15 is configured such that, as shown in FIGS. 6 through 9, a pair of operating members 17*b* protruding outside from a notched portion 51*a* of the aforementioned pair of the side walls 51 is consecutively installed to a sliding piece 16 inserted into the aforementioned sliding groove 53 in a manner such that both side ends are engaged with insides of the projecting walls 54 and a base plate portion 17*a* being connected with the sliding piece 16 so as to cover an outer face thereof. Accordingly, the latching mechanism 15 is provided with a latch main body 17 which is slidable in an above and below direction with the aforementioned sliding piece 16 within a definite range and the latching mechanism 15 is further provided with a position adjusting device 55 for adjusting a lowering position of the sliding piece 16 and the latch main body 17.

In more detailed explanation, the aforementioned sliding piece 16 includes a hooking portion 16*a* to be hooked with the receiving hole 13*a* formed in the aforementioned operating doorframe 13, and in the hooking portion 16*a*, a slanting portion 16*b* with which a lower edge of the receiving hole 13*a* of the aforementioned operating doorframe 13 collides when the aforementioned operating doorframe 13 moves to the closing position. The sliding piece 16 further includes a hooking hole 16*c* for hooking a hooking portion 17*e* provided at both ends of the latch main body 17 in a longitudinal direction.

On the other hand, the aforementioned latch main body 17 is provided with the pair of the operating members 17*b* respectively protruding outward from the notched portion 51*a* of the pair of the side walls 51 in the aforementioned base plate portion 17*a*, a penetrating hole 17*c* there the aforementioned hooking portion 16*a* passes through, an elongated hole 17*d* formed at a lower position, and the aforementioned hooking portion 17*e* to be hooked with the hooking hole 16*c* of the slide piece 16.

Further, the aforementioned position adjusting device 55 is provided with a stopper member 56 having a screw hole at a center thereof and being inserted in a manner so as to be hooked with inside of the projecting walls 54 in the aforementioned sliding groove 53, and an adjusting screw 57 to be screwed into a screw hole of the aforementioned stopper member 56 through the elongated hole 17*d* formed in the aforementioned latch main body 17. The stopper member 56 is fixed in a manner so as to be free for adjusting a position by being pressed to the projecting walls 54 of the sliding groove 53 by means of reaction force that occurs when the aforementioned adjusting screw 57 which is screwed into the screw hole presses the bottom wall of the sliding groove 53 by screwing operation. The aforementioned stopper member 56 is configured to limit the lowering position of the sliding piece 16 and the latch main body 17 that lower by their own weight, and a hooking portion to be hooked with them at the set lowering position of the sliding piece 16 or the latch main body 17 is formed at an upper end portion thereof.

In the aforementioned latching mechanism 15, since the aforementioned stopper member 56 is fixed to the aforementioned projecting walls 54 in a manner so as to be position adjustable, the lowering position of the aforementioned latch main body 17 being lowered by its own weight can by easily adjusted. Accordingly, the aforementioned latching mechanism 15 can be easily configured such that the hooking portion 16*a* is positioned to be able to be hooked with the receiving hole 13*a* of the aforementioned operating doorframe 13 when the aforementioned latch main body 17 is placed at a lowering position.

In the latching mechanism 15, when the aforementioned operating doorframe 13 moves toward the closing position, a peripheral wall of the receiving hole 13*a* of the aforementioned operating doorframe 13 passes through, while pressing up the slanting portion 16*b* of the aforementioned hooking portion 16*a*, and when the peripheral wall of the receiving hole 13*a* of the aforementioned operating doorframe 13 passes over the slanting portion 16*b* of the aforementioned hooking portion 16*a*, the aforementioned latch main body 17 falls down by its own weight and the aforementioned hooking portion 16*a* is automatically latched with the peripheral wall of the receiving hole 13*a* of the aforementioned operating doorframe 13. Therefore, the aforementioned hooking portion 16*a* can be automatically latched with the receiving hole 13*a* of the aforementioned operating doorframe 13 only by moving the aforementioned operating doorframe 13 toward the closing position, and accordingly, the aforementioned operating doorframe 13 can be locked at the closing position.

When the locked state of the aforementioned latching mechanism 15 is released, it is sufficient to only press up the aforementioned operating member 17*b* resisting against the force of gravity. When the aforementioned operating member 17*b* is pressed up, the aforementioned hooking portion 16*a* is raised and the latched state of the hooking portion 16*a* with the receiving hole 13*a* of the aforementioned operating doorframe 13 is released. As a result, the aforementioned operating doorframe 13 moves toward an opening direction by means of action force of the aforementioned sinker 26 that affects the aforementioned operating doorframe 13 via the wire 14.

Thus, the embodiment of the sliding screen door with respect to the present invention is described in detail. However, the present invention is not limited to the sliding screen door described in the aforementioned embodiment, and various modifications can be made in design without departing from the spirit of the invention described in the claims of the present invention.

The invention claimed is:

1. A sliding screen door comprising:

a frame body;

an operating doorframe mounted to the frame body for movement in a horizontal direction;

a pleated screen having vertical pleats, wherein one end of the screen is fixed to an elongated endplate at a vertical frame member of the frame body and another end of the screen is attached to the operating doorframe, whereby the screen is freely movable in the frame body to be fully closed by movement of the operating doorframe away from the vertical frame member;

a wire having one end fixed to a wire adjusting mechanism at the vertical frame member and being horizontally inserted into the screen, and wherein the wire extends into the operating doorframe and a guide member is provided in the operating doorframe to guide the wire downward therein;

a sinker mounted to an end of the wire in the operating doorframe and freely vertically movable in the operating doorframe, whereby the weight of the sinker stretches the wire; and a spring member in the operating doorframe and surrounding the wire, the spring member being positioned between the sinker and a contacting portion of the operating doorframe, wherein the wire adjusting mechanism is adjustably mounted to the vertical frame member, and wherein the mounting position of the wire adjusting mechanism on the vertical frame member is adjusted such that the spring member is compressed between the sinker and the contacting portion when the screen is fully closed, whereby a resilient expansion force of the spring applies a stretching force to the wire, wherein the wire adjusting mechanism comprises a guide part having a first wire connection portion and attached to the vertical frame member, and an adjusting member having a second wire connection portion and capable of sliding along a longitudinal direction of the vertical frame member and being attached to the vertical frame member, wherein the first and second wire connecting portions are longitudinally bent in opposite directions to hook the wire, and wherein the wire is passed through the guide part, bent by the guide part to extend toward the adjusting member in the longitudinal direction of the vertical frame member, and fixed to the first or second wire connection portion of one of the guide part and the adjusting member, wherein the vertical frame member comprises a longitudinal sliding groove slidably housing the guide part and the adjusting member, and opening in a direction facing the screen, and wherein the elongated endplate of the screen is detachably mounted to the vertical frame member so as to cover the guide part and the adjusting member in the sliding groove.

2. The sliding screen door according to claim 1, wherein the adjusting member is an approximately plate-shaped member comprising a first screw hole, further comprising a first fixing screw in the first screw hole and detachably fixing the adjusting member to the sliding groove, wherein the first fixing screw is screwed from an opening side of the sliding groove to the first screw hole, and wherein the guide part is an approximately plate-shaped member fixed to the sliding groove.

3. The sliding door according to claim 2, wherein the sliding groove in the vertical frame member has an approximately C-shaped section, comprising projecting walls inwardly protruding at a pair of groove side walls of the sliding groove, and wherein the adjusting member and a first nut cooperate to sandwich the projecting walls therebetween, thereby detachably fixing the adjusting member to the sliding groove, where the first fixing screw is screwed through the first screw hole of the adjusting member.

4. The sliding door according to claim 2, wherein the guide part comprises a second screw hole where a second fixing screw for detachably fixing the guide part to the sliding groove is screwed, and wherein the second fixing screw is screwed from an opening side of the sliding groove to the second screw hole.

5. The sliding door according to claim 4, wherein the sliding groove in the vertical frame member has an approximately C-shaped section, comprising projecting walls inwardly protruding at a pair of groove side walls of the sliding groove, and wherein the adjusting member and a first nut cooperate to sandwich the projecting walls therebetween, thereby detachably fixing the adjusting member to the sliding groove, where the first fixing screw is screwed through the first screw hole of the adjusting member.

6. The sliding screen door according to claim 1, further comprising a latching mechanism installed in the frame body, wherein the latching mechanism can automatically latch with a receiving hole formed in the operating doorframe when the operating doorframe is moved to the closing position, and a latched state of the latching mechanism is released by raising an operating member against the force of gravity.

7. The sliding screen door according to claim 6, wherein the latching mechanism comprises:

a sliding piece vertically slidable within a defined range in the frame body;

a latch main body connected to the sliding piece; and a position adjusting device for adjusting a lower position of the latch main body.

8. The sliding screen door according to claim 7, wherein the vertical frame member comprises a pair of side walls extending in a longitudinal direction and having a notched portion at a position wherein the latching mechanism is installed, and a connecting wall connecting the pair of the side walls and comprising a sliding groove extending in a longitudinal direction, wherein the sliding piece comprises a hooking portion slidably inserted into the sliding groove and latched with a receiving hole formed in the operating doorframe, and wherein the latch main body comprises said operating member outwardly protruding from the notched portion of the side walls.

9. The sliding screen door according to claim 1, wherein the sliding groove is formed as an approximately C-shaped section by an opposing pair of groove side walls extending in a longitudinal direction, and by a groove bottom wall extending in a longitudinal direction and provided between the pair of groove side walls, wherein the pair of groove side walls has an opposing pair of projecting walls projecting toward an inside of the sliding groove and extending in the longitudinal direction of the vertical frame member, wherein the guide part is detachably mounted to the projecting walls, and the adjusting member is detachably and slidably mounted to the projecting walls, and wherein the wire, having been bent by the guide part to extend toward the adjusting member in the longitudinal direction of the vertical frame member, passes through a space between the projecting walls and the groove bottom wall.

10. The sliding screen door according to claim 1, further comprising a pair of opposing concave grooves extending in the longitudinal direction of the vertical frame member at open ends of the pair of groove side walls, wherein the elongated endplate of the screen is detachably fixed to the pair of concave grooves.

* * * * *